United States Patent [19]

Marston et al.

[11] 4,046,681

[45] Sept. 6, 1977

[54] MULTIPLE MATRIX ASSEMBLY AND MATRIX UNIT FOR MAGNETIC SEPARATOR WITH SIMPLIFIED SEALING

[75] Inventors: Peter G. Marston, Gloucester; John J. Nolan, Cambridge, both of Mass.

[73] Assignee: Sala Magnetics, Inc., Cambridge, Mass.

[21] Appl. No.: 594,708

[22] Filed: July 10, 1975

[51] Int. Cl.[2] ..... B03C 1/02

[52] U.S. Cl. ..... 209/224; 209/231; 210/222

[58] Field of Search ..... 209/232, 223, 231; 210/222, 223, 224

[56] References Cited

U.S. PATENT DOCUMENTS

| | | | |
|---|---|---|---|
| 2,154,010 | 4/1939 | Queneau | 209/232 X |
| 2,329,893 | 9/1943 | Girard | 210/222 |
| 2,437,681 | 3/1948 | Crockett | 209/232 |
| 2,508,680 | 5/1950 | Frantz | 209/232 X |
| 3,400,823 | 9/1968 | Cooper | 210/223 |
| 3,567,026 | 3/1971 | Kolm | 210/222 |
| 3,581,898 | 6/1971 | Tyrell | 210/222 |
| 3,770,029 | 11/1973 | Nolan | 210/222 X |

FOREIGN PATENT DOCUMENTS

| | | | |
|---|---|---|---|
| 796,336 | 6/1958 | United Kingdom | 210/222 |
| 804,638 | 11/1958 | United Kingdom | 210/223 |

*Primary Examiner*—Robert Halper
*Attorney, Agent, or Firm*—Joseph S. Iandiorio

[57] ABSTRACT

A multiple matrix assembly for a magnetic separator including a container; a plurality of magnetic matrices arranged in a longitudinal stacked array in the container; each matrix having a feed area and a collection area on opposite longitudinal ends transverse to the longitudinal axis of the container and the flow through it; and having a peripheral portion surrounding it and extending longitudinally between the feed and collection areas, the matrices being disposed with the feed areas all facing in a first direction and their collection areas all facing in a second direction; inlet and outlet means in the container for feeding to and collecting from the matrices; and receptacle means, disposed between each pair of adjacent matrices, each of the receptacle means including a transverse member proximate and coextensive with a one of the feed and collection areas and a peripheral member extending longitudinally in one of the first and second directions from the transverse member along and sealingly engaged with the peripheral portion of the matrix.

7 Claims, 6 Drawing Figures

MULTIPLE MATRIX ASSEMBLY AND MATRIX UNIT FOR MAGNETIC SEPARATOR WITH SIMPLIFIED SEALING

FIELD OF INVENTION

This invention relates to a multiple matrix assembly and a matrix unit for use in such an assembly in a magnetic separator which eliminates the need for certain critical seals.

BACKGROUND OF INVENTION

Multiple matrix magnetic separators typically use an annular electromagnetic coil or group of coils to provide a magnetic field volume in the space encompassed by the electromagnetic coils. There is a plurality of magnetic matrices arranged in a stacked array in a container within the space encompassed by the electromagnetic coil. Each magnetic matrix generally includes ferromagnetic material such as steel wool or expanded metal enclosed in the container which may be made of stainless steel or other material of low magnetic permeability. The electromagnetic coil, matrices and container may be enclosed in a ferromagnetic return frame to increase the efficiency of the magnetic circuit. The technique of stacking magnetic matrices adjacent to each other to achieve a predetermined matrix area instead of using a single matrix in the same area is employed to reduce the volume of the ferromagnetic return frame surrounding the coil and thereby reduce the cost of the device, a significant portion of which cost is constituted by the cost of the ferromagnetic return frame. Each additional layer used in the stack to accomplish a particular area requirement reduces the diameter of the top and bottom portions of the return frame, the intermediate cylindrical portion, and the electromagnetic coil and increases the length of the coil and cylindrical portion of the frame in the longitudinal direction of slurry flow through the matrices. The number of matrices used to accomplish a particular process capacity is optimized for maximum efficiency.

Typically the feed is submitted to the feed area on one side of each matrix and the separation product or products are recovered from the collection area on the opposite side of each matrix. All matrices have their feed areas facing in one direction and their collection areas facing in the opposite direction. Thus in the stack the feed area of one matrix is immediately adjacent the collection area of an adjacent matrix. Some means is provided between each pair of adjacent matrices in order to ensure that there is no leakage between these two areas. Often a partition is used which is sealed to the container at the periphery of the partition. Practical and useful seals may be accomplished when such machines are small e.g. six or eight inches in width or diameter. However, when the machines are of production size 30 inches, 100 inches or even more in width or diameter such peripheral or circumferential seals are extremely difficult to install and maintain. Yet these seals must be maintained with the utmost integrity for a leak in this area can substantially decrease the efficiency and economy of operation of the multiple matrix magnetic separator: the leak from the feed area of one matrix to the collection area of the next matrix contaminates the separation products at the output with the unseparated feed at the input.

SUMMARY OF INVENTION

It is therefore an object of this invention to provide a matrix assembly for a multiple matrix magnetic separator which eliminates the need for certain critical seals.

It is a further object of this invention to provide a simple, leakproof matrix unit which may be used in the multiple matrix assembly according to this invention.

The invention results from the realization that the difficulty of sealing may be substantially decreased and the need for certain critical seals be eliminated completely if the use of a multiple matrix assembly is arranged so that any communication between any particular matrix and any other matrix in the assembly is restricted to occur only at the same processing level e.g. input feed comingles with input feed; recovery product comingles with recovery product.

The invention features, in a preferred embodiment, a multiple matrix assembly for a magnetic separator including a container and a plurality of magnetic matrices arranged in a longitudinal stacked array in the container. Each matrix has a feed area and a collection area on opposite longitudinal ends of the matrix transverse to the longitudinal axis of the container and the flow through it. Each matrix has a peripheral portion surrounding it and extending longitudinally between the feed and collection areas. The matrices are disposed with their feed areas all facing in a first direction and their collection areas all facing in a second direction. Inlet and outlet means in the container feed to and collect from the matrices. Receptacle means disposed between each pair of adjacent matrices include a transverse member proximate to and coextensive with a one of the feed and collection area of a matrix and include a peripheral member which extends longitudinally in one of the first and second directions from the transverse member along and sealingly engaged with the peripheral portion of the matrix.

The peripheral member may extend in a second direction from the transverse member and the force of gravity may be exerted in a first direction. In one construction the inlet and outlet means extend longitudinally in the stacked array of matrices and include ports in each transverse member. A sleeve member surrounds each port, is interconnected with the transverse member, and extends through one or more matrices. One or more sleeves extend from the transverse member in the first direction and one or more sleeves extend from a transverse member in the opposite direction. In addition to the receptacle provided between each pair of adjacent matrices there may be an additional receptacle with its transverse member disposed between the end of the container, in the opposite direction from the direction in which the peripheral members extend, and the matrix adjacent that end.

The invention also features a matrix unit for a multiple matrix assembly for a magnetic separator in which the matrix units are arranged longitudinally in a stacked array. The matrix unit includes a magnetic matrix having first and second areas on opposite longitudinal ends of the matrix and transverse to the longitudinal axis of the matrix and to the longitudinal flow through it. Each matrix has a peripheral portion surrounding it and extending longitudinally between the first and second areas. There is a receptacle for housing the matrix which receptacle has a transverse member proximate and coextensive with one of the first and second areas of the matrix and a peripheral member which extends longitudinally from a transverse member along and sealingly engaged with the peripheral portion of the matrix. In some constructions the matrix unit may include at least two ports in the transverse member for accommodating inlet and outlet means and at least one sleeve about each port extending in each direction from the transverse member through one or more matrices.

In an alternative embodiment the multiplex matrix assembly for a magnetic separator may include a container in which are disposed a plurality of magnetic matrices each having a feed area and a collection area and a peripheral portion. The matrices are arranged in a stacked array in the container with like areas of adjacent matrices facing each other. The peripheral portion of each of the matrices is sealingly engaged with the container.

DISCLOSURE OF PREFERRED EMBODIMENTS

Other objects, features and advantages will occur from the following description of preferred embodiments and the accompanying drawings, in which.

Figure 1:
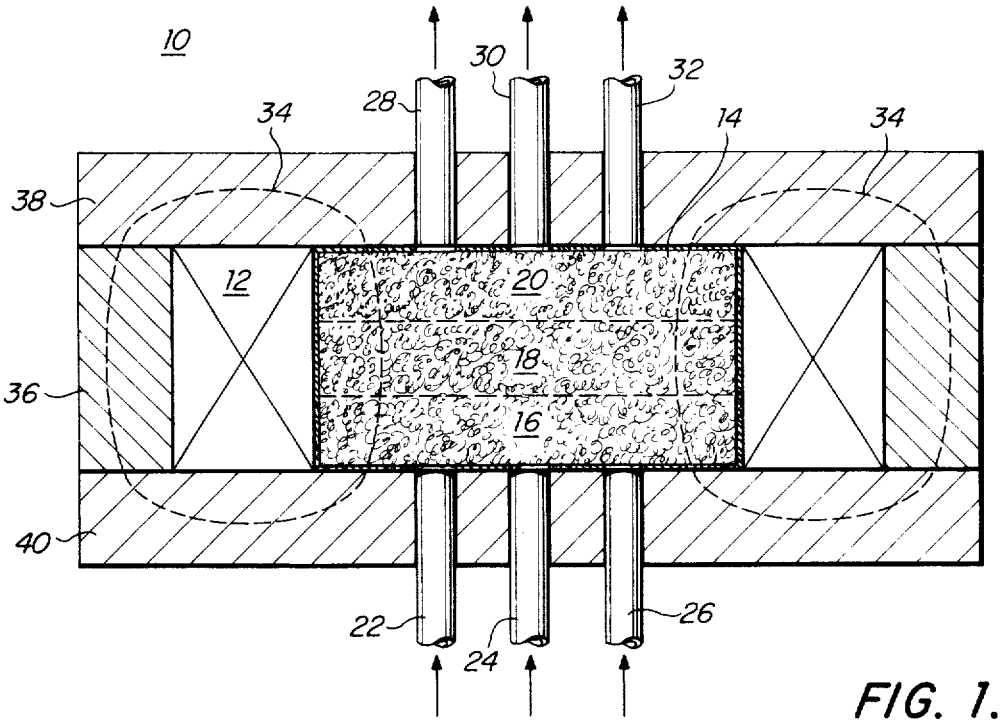
FIG. 1 is a schematic, cross-sectional diagram of a multiple matrix magnetic separator.

There is shown in FIG. 1 a multiple matrix magnetic separator 10 including an annular electromagnetic coil 12 surrounding cylindrical container 14 containing three magnetic matrices 16, 18 and 20 which receive feed from three inlets 22, 24 and 26 and provide the products of separation at outlets 28, 30 and 32. The function of the inlets and outlets may be reversed: inlets 22, 24 and 26 may become the outlets and outlets 28, 30 and 32 may become the inlets. Electromagnetic coil 12 provides a magnetic field, lines 34, in the matrices 16, 18 and 20 which may be made, for example, of stainless steel wool. Container 14 and coil 12 may be entirely surrounded by a ferromagnetic return frame including a cylindrical portion 36 and top and bottom circular plates 38 and 40.

Figure 2:
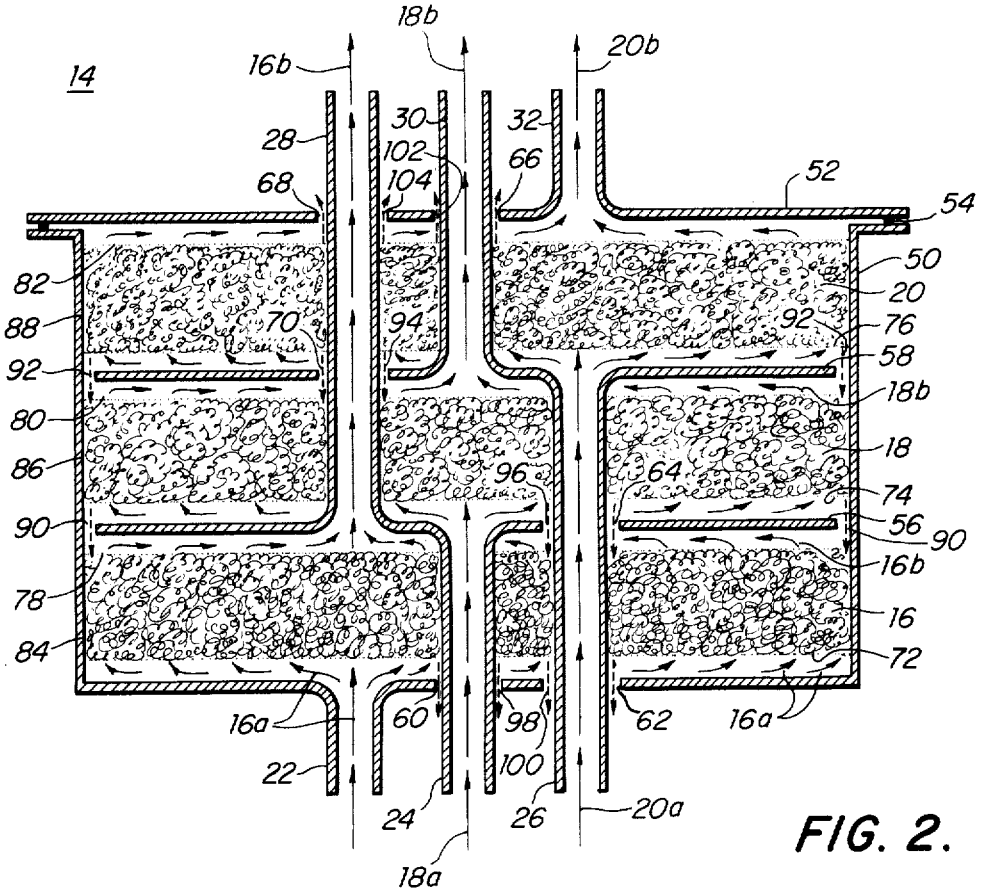
FIG. 2 is a schematic, sectional view of a multiple matrix container illustrating flow patterns and leakage patterns in an unsealed assembly.

Container 14 is shown in greater detail in FIG. 2 where it includes vessel 50 and cover 52 sealingly engaged by an "O" ring or seal 54. Matrix 16 is separated from matrix 18 by partition 56 and matrix 18 is separated from matrix 20 by partition 58. Inlet 22 is integrally formed with the bottom of vessel 50; inlet 24 is integrally formed with partition 56 and passes through port 60 in the bottom of vessel 50. Similarly inlet 26 is integrally formed with partition 58 and passes through port 62 in the bottom of vessel 50 and port 64 in partition 56.

Similarly outlet 32 is integrally formed with cover 52. Outlet 30 is integrally formed with partition 58 and passes through port 66 in cover 52. Outlet 28 is integrally formed with partition 56 and passes through port 68 in cover 52 and port 70 in partition 58.

Matrices 16, 18 and 20 are arranged in a longitudinal stacked array with their feed areas 72, 74 and 76, respectively, facing in one direction and their collection areas 78, 80 and 82, respectively, facing in the other direction. A peripheral portion 84, 86, 88 of each of matrices 16, 18 and 20, respectively, is snugly, sealingly engaged with the walls of vessel 50.

Feed, depicted by arrows **16*a*, entering inlet 22 is delivered to the feed area 72 of matrix 16. The separation product, arrows 16*b*, is collected at the collection area 78 and delivered through outlet 28. Similarly the feed, arrows 18*a*, entering inlet 24 is submitted to the feed area 74 of matrix 18 and the products 18*b* of the separation process are collected and delivered through outlet 30. Feed, arrows 20*a*, entering inlet 26 is delivered to feed area 76 of matrix 20 and the product 20*b* is collected at the collection area 82 and delivered to outlet 32.**

In operation, the feed present at the feed areas of each matrix as indicated by the arrows **16*a*, 18*a* and 20*a* is at relatively high prssure while the separation products collected in the areas indicated by arrows 16*b*, 18*b* and 20*b* are at relatively low pressure. As a result of the separation process the more magnetic particles are retained in the various matrices while the less magnetic particles are contained in the products delivered at outlets 28, 30 and 32. The separation operation may also include ceasing the feed delivery at inlets 22, 24 and 26 and providing a forward rinse at inlets 22, 24 and 26 or a reverse rinse at outlets 28, 30 and 32** to rinse out middlings. Finally, the magnetic field may be reduced or completely eliminated and the matrices flushed either in the same direction as the feed was delivered or in the reverse direction to remove the more magnetic particles adhered to the matrices in the presence of the magnetic field.

There are three important leakage areas that are of concern in a structure such as depicted by container 14 in FIG. 2. There is the possibility for leakage around partition 56 as indicated by dashed arrows 90 where the feed **18*a* being presented to the feed area 74 of matrix 18 may leak back to the collection area 78 of matrix 16 and contaminate the product of the separation. A similar leak may occur around partition 58 as indicated by dashed arrows 92. These leaks are of critical importance because they act directly to reduce the efficiency of the separation by contaminating the end product with the input feed. They are of particular concern because, as expressed earlier, in larger machines where the diameter, or transverse dimension in non-cylindrical devices, is large, on the order of 60, 80 or 100 inches or more, the sealing around such a large periphery is extremely difficult to maintain because of manufacturing tolerances, seal distortion and other problems. A second critical area of leakage occurs at port 70 in partition 58 and port 64 in partition 56 as indicated by dashed arrows 94 and 96, respectively. Here the feed for matrices 18 and 20 may leak through ports 64 and 70 to contaminate the collection product from matrices 16 and 18, all respectively. This is a somewhat easier leak to overcome due to the fact that inlet 26 and outlet 28 are typically not extremely large in diameter. The third and least critical of these leaks occurs in the area of ports 60 and 62 as indicated by dashed arrows 98 and 100 and in the area of port 66 and 68 as indicated by dashed arrows 102 and 104, respectively. These leaks only cause a loss of the feed, ports 60, 62, or collected product, ports 66 and 68,** but they do not cause contamination of the end product.

Figure 3:
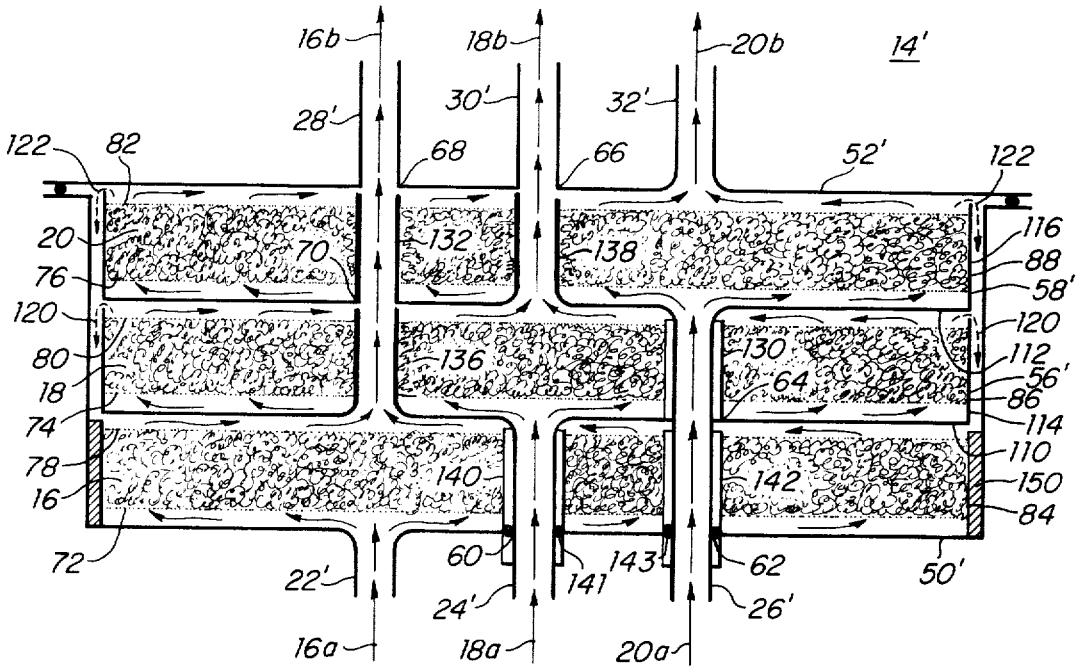
FIG. 3 is a schematic sectional diagram of a multiple matrix assembly according to this invention.

In a preferred embodiment of this invention, FIG. 3, where like parts have been given like numbers and similar parts, like numbers primed the more critical leaks have been eliminated or rendered harmless without the use of seals by replacing partitions 56, 58 and each pair of adjacent matrices 16 and 18 and 18 and 20 with receptacles 56' and 58' which include transverse members 110 and 112 and peripheral members 114 and 116. The peripheral portion 86 of matrix 18 is snugly and sealingly engaged with transverse member 114. Thus feed **18*a* is isolated between transverse member 110 and matrix 18. After it passes through matrix 18 and emerges from collection area 80 as a product of the separation it may overflow or leak around the edge of peripheral member 114 as indicated by dashed arrow 120 but in that event it only trickles down between peripheral member 114 and the wall of vessel 50 to the collection area of matrix 16 where the product 20*b*** of separation is present. Thus there is no contamination of the collected product by the feed.

The same condition occurs with respect to matrix 20 where peripheral member 116 extends upward preferably but not necessarily beyond the collection area 82 of matrix 20. Permissible leakage there is indicated by arrows 122. The second source of leaks in FIG. 2, in the area of ports 64 and 70, may be eliminated by using sleeves 130 and 132, respectively, which are sealingly interconnected with their respective transverse members 110 and 112 and extend in the same direction as peripheral members 114 and 116 through matrices 18 and 20, respectively. In addition the isolation of the collection functions of outlets 28 and 30 with respect to matrices 16 and 18 may be eliminated so that all the low pressure collection areas are in communication. This is effected by using two additional sleeves 136 and 138 which are integrally connected to transverse members 110 and 112, and which extend in the same direction as the other sleeves, from the transverse members 110 and 112 through the matrix to, and preferably, but not necessarily, beyond the collection area of the respective matrices. The third leakage area at ports 66 and 68 and ports 60 and 62 depicted in FIG. 2 are also eliminated in a similar fashion. Leaks at ports 66 and 68 are eliminated by directly, integrally connecting outlets 30' and 28' to cover 52'. The problem with ports 60 and 62 may be eliminated in the same fashion by the use of sleeves 140 and 142, respectively, which extend in the same direction as peripheral members 114 and 116 through matrix 16. Conventional seals 141, 143 such as O-rings are used between sleeves 140, 142 and inlets 24', 26', respectively.

Although in the description of FIGS. 1, 2 and 3, thus far, the feed is entered through the bottom of the matrices and the recovery is through the top, this is not a necessary limitation of the invention. The feed may be delivered at the top and the product recovered at the bottom when the longitudinal axes of the matrices are aligned with the vertical axis. However, the separator 10 including container 14 may be operated with the longitudinal axis of the matrix horizontal as well as vertical or at any angle in between i.e. the multiple matrix assembly will operate in all orientations regardless of the direction chosen for the introduction of feed or recovery of product and regardless of the direction of the force of gravity with respect to the longitudinal axis of the matrices. Also, the peripheral members 114 and 116 have been shown extending in a longitudinal direction in the same sense of direction as the motion of feed through the matrices. This is not a necessary limitation of the invention. For example, the peripheral member 114 may extend from transverse member 110 in the opposite direction from that shown so that it engages with matrix 16 instead of matrix 18; and peripheral member 116 may extend in the opposite direction from transverse member 112 so that it engages with matrix 18 instead of matrix 20. In that condition the sleeves 132, 138, 136, 130, 140 and 142 would also be rearranged to extend from their respective transverse members in the same direction as the peripheral members. In the illustration of FIG. 3 matrix 16 requires no separate peripheral member or transverse member as it cooperates with the bottom and the side of container 50'. In FIG. 3 in order to keep matrix 16 of uniform size with respect to matrices 18 and 20 a peripheral spacer 150 has been deployed between the wall of vessel 50' and matrix 16. In the event that the direction of peripheral members 114, 116 and the various sleeves is reversed this spacer 150 would be used in conjunction with matrix 20, instead of matrix 16 and would cooperate with the cover 52' and the wall of vessel 50'.

Figure 4:
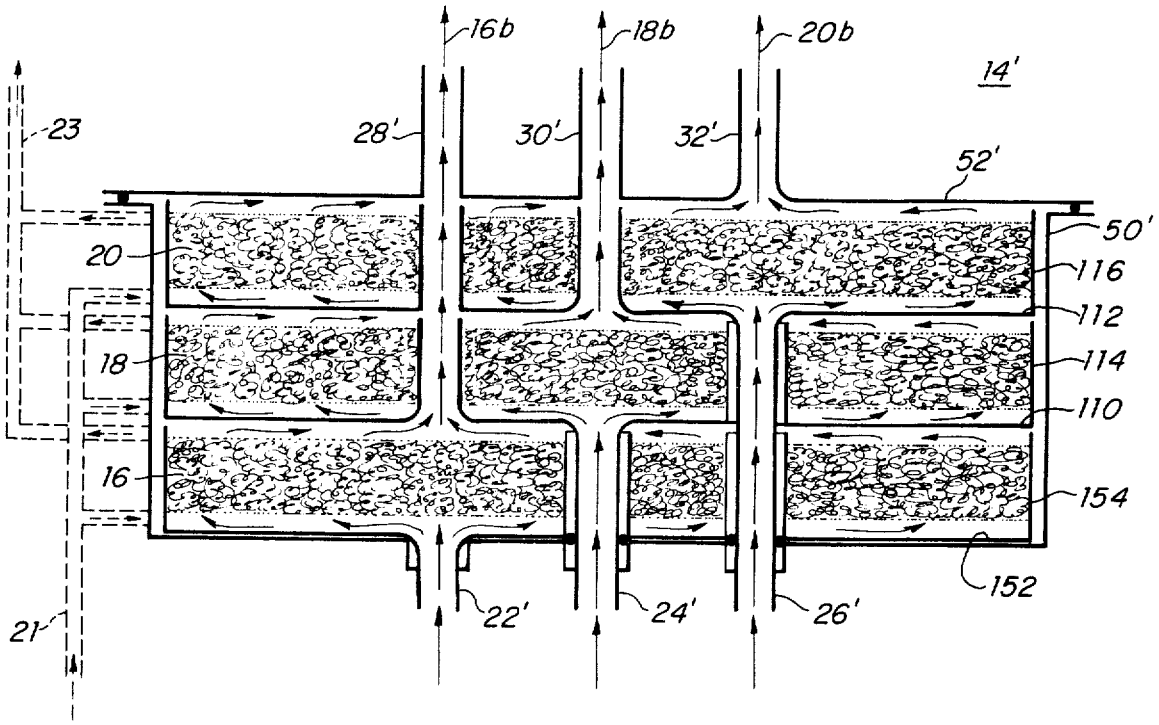
FIG. 4 is a schematic sectional diagram of an alternative construction of a multiple matrix assembly according to this invention.

Alternatively, in order to provide uniform fabrication processes each of the matrices may have associated with it a receptacle having a transverse member and peripheral member as shown in FIG. 4 where matrix 16 also includes a receptacle including a transverse member 152 and peripheral member 154, and where like parts have been given like numbers and similar parts like numbers primed with respect to FIGS. 1, 2 and 3. The inlets and outlets need not be disposed longitudinally through the matrices. The inlets 21 and outlets 23, as shown in phantom in FIG. 4, may be connected at the side of the matrices. Further, the number of inlets and outlets is not restricted to three or any other particular number. For example, if only two matrices were used with each served by only one inlet and outlet, then there need by only two each inlets and outlets and the receptacle need have only two ports, one with a sleeve extending in one direction, the other with the sleeve extending in the other direction. Increasing the number of inlets and outlets per matrix and the number of matrices per stack increases the number of holes required in each matrix and the number of sleeves extending in each direction from the transverse member.

Figure 5:
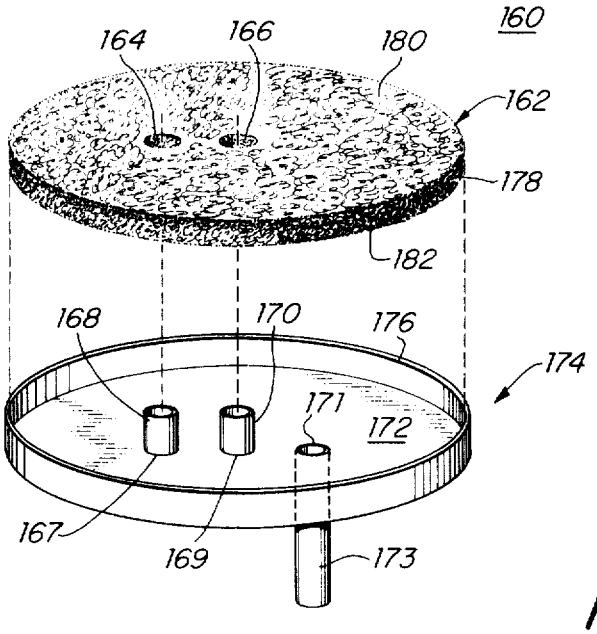
FIG. 5 is an exploded axonometric view of a matrix unit according to this invention.

A single matrix unit 160 is shown in FIG. 5 as including a matrix 162 with two holes 164 and 166 which accommodate sleeves 168 and 170, respectively mounted on transverse member 172 of receptacle 174. Peripheral member 176 engages peripheral portion 178 of matrix 162 and extends to or beyond area 180 of matrix 162. The other area 182 is disposed proximate the transverse member 172 when matrix 162 is properly positioned in receptacle 174. Sleeves 168, 170 surrounding holes 167, 169, respectively, extend in the same direction as peripheral member 178 and sleeve 173 surrounding hole 171 extends in the other direction through at least one matrix.

Figure 6:
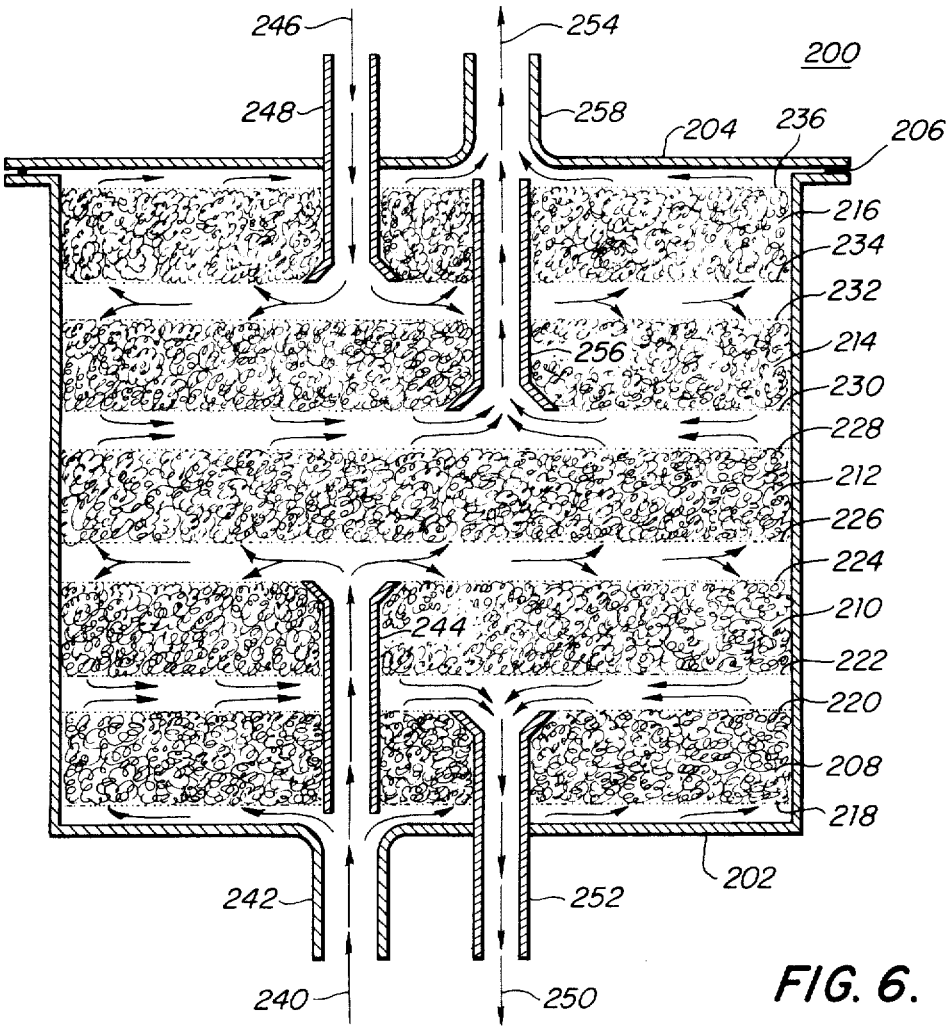
FIG. 6 is an alternative embodiment of a multiplex matrix assembly according to this invention.

In an alternative embodiment, a multiple matrix assembly with two or more matrices may be constructed so that like areas of adjacent matrices are facing each other to eliminate any leakage problem. This construction is particularly useful in situations where gravity and its effects are not a primary concern. Such an assembly is shown in FIG. 6 where container 200, including vessel 202 and cover 204 sealingly engaged by means of seal 206 with vessel 202, holds five matrices 208, 210, 212, 214 and 216. The feed area 218 of matrix 208 is proximate the bottom of vessel 202 while its collection area 220 is adjacent the collection area 222 of matrix 210. The feed area 224 of matrix 210 is joined with the feed area 226 of matrix 212 which in turn has its collection area 228 joined with the collection area 230 of matrix 214. Matrix 214 has its feed area 232 coupled with the feed area 234 of matrix 216 whose collection area 236 is proximate cover 204.

Feed 240 directed into inlet 242 is fed directly into the feed area 218 of matrix 208 and through conduit 244 to the feed areas 224 and 226 of matrices 210 and 212, respectively. The feed areas 232 and 234 of matrices 214 and 216 are fed with feed 246 through inlet 248.

The output product 250 from the collection areas 220 and 222 of matrices 208 and 210 is collected in outlet 252, while the output product 254 from collection areas 228 and 230 of matrices 212 and 214 is received in conduit 256 which feeds outlet 258 that also collects the output product from collection area 236 of matrix 216. Each of the matrices 208, 210, 212, 214 and 216 have their peripheral portions snugly engaged with the wall of vessel 202 and the matrices are also snugly engaged with conduits 244 and 256 and inlet 248 and outlet 252. Thus the only path for fluid is through the matrices and there is no interaction between the input or feed areas and the output or collection areas of the various matrices.

Other embodiments will occur to those skilled in the art and are within the following claims:

What is claimed is:

1. A multiple matrix assembly for a magnetic separator comprising:

a container;

a plurality of magnetic matrices arranged in a longitudinal stacked array in said container; each matrix having a feed and a collection area on opposite longitudinal ends transverse to the longitudinal axis of said container and the flow through it, and having a peripheral portion surrounding it and extending longitudinally between said feed and collection areas, said matrices being disposed with their feed areas all facing in a first direction and their collection areas all facing in a second direction;

inlet and outlet means in said container for feeding to and collecting from said matrices; and open receptacle means, disposed between each pair of adjacent matrices, each of said receptacle means including a transverse member proximate and coextensive with only one of said feed and collection areas, and a peripheral member extending longitudinally in one of said first and second directions from said transverse member along and sealingly engaged with said peripheral portion of said matrix.

2. The multiple matrix assembly of claim 1 in which said peripheral member extends in said second direction from said transverse member.

3. The multiple matrix assembly of claim 1 in which the force of gravity is exerted in said first direction.

4. The multiple matrix assembly of claim 1 in which said inlet and outlet means extend longitudinally in said stacked array of matrices and include ports in each said transverse member and a sleeve member surrounding each said port interconnected with said transverse member and extending through one or more matrices, at least one sleeve extending in said first direction and at least one sleeve extending in said second direction.

5. The multiple matrix assembly of claim 1 in which there is an additional receptacle having its transverse member disposed between the end of said container, which is at the opposite end from that toward which said peripheral members extend, and the matrix adjacent that end.

6. A multiple matrix assembly for a magnetic separator comprising:

a container;

a plurality of magnetic matrices each having a feed area, a collection area on opposite longitudinal ends, and a peripheral portion and being arranged in a longitudinal stacked array in said container with like areas of adjacent matrices facing each other; each of said matrices having its longitudinal ends spaced from adjacent said matrices, to form common, alternate feed and collection areas; the peripheral portion of each of said container; and inlet means and outlet means for feeding to and collecting from said common feed and collection areas.

7. A matrix unit for a multiple matrix assembly for a magnetic separator in which the matrix units are arranged longitudinally in a stacked array comprising:

a magnetic matrix having first and second areas on opposite longitudinal ends of said matrix transverse to the longitudinal axis of said matrix and to the longitudinal flow through it, and having a peripheral portion surrounding it and extending longitudinally between said first and second areas; and an open receptacle for housing said matrix and having a transverse member proximate to and coextensive with only one of said first and second areas and a peripheral member extending longitudinally from said transverse member along and sealingly engaged with said peripheral portion of said matrix;

said transverse member including at least two ports for accommodating inlet and outlet means and a sleeve extending from said transverse member about each port through one or more matrices, at least one sleeve extending in each direction.

* * * * *